US008360081B2

(12) United States Patent
Zweideck

(10) Patent No.: US 8,360,081 B2
(45) Date of Patent: Jan. 29, 2013

(54) SUNSHADE

(75) Inventor: Bruno Zweideck, Cholet (FR)

(73) Assignee: Cosco Management, Inc., Wilmington, DE (US)

( * ) Notice: Subject to any disclaimer, the term of this patent is extended or adjusted under 35 U.S.C. 154(b) by 298 days.

(21) Appl. No.: 12/732,982

(22) Filed: Mar. 26, 2010

(65) Prior Publication Data

US 2010/0243010 A1 Sep. 30, 2010

(30) Foreign Application Priority Data

Mar. 30, 2009 (FR) ..... 09 51999

(51) Int. Cl.
*A45B 25/02* (2006.01)
*A45B 25/18* (2006.01)

(52) U.S. Cl. ..... 135/31; 135/16; 135/33.4; 297/184.16; 280/650

(58) Field of Classification Search ..... 135/15.1, 135/19.5, 25.34, 27, 29, 31–32, 33.4–33.5, 135/98, 16; 297/184.1, 184.15, 184.16; 280/47.38, 280/647, 650
See application file for complete search history.

(56) References Cited

U.S. PATENT DOCUMENTS

| | | | | |
|---|---|---|---|---|
| 33,472 | A * | 10/1861 | Bancroft | 135/33.41 |
| 145,733 | A | 12/1873 | Griswold | |
| 1,547,538 | A * | 7/1925 | Vincent | 135/15.1 |
| 4,624,275 | A * | 11/1986 | Baldwin | 135/19.5 |
| 5,305,771 | A * | 4/1994 | Wilk | 135/31 |
| 5,390,685 | A * | 2/1995 | McCoy | 135/19 |
| 5,394,896 | A * | 3/1995 | Wilk | 135/31 |
| 5,694,958 | A * | 12/1997 | Chang | 135/33.5 |
| 5,855,220 | A | 1/1999 | Wu | |
| 6,357,461 | B1 * | 3/2002 | Chai et al. | 135/88.09 |
| 6,904,923 | B2 * | 6/2005 | Chai et al. | 135/88.09 |
| 2005/0247333 | A1 * | 11/2005 | Nipke | 135/24 |

FOREIGN PATENT DOCUMENTS

| | | |
|---|---|---|
| FR | 1646 | 9/1903 |
| JP | 2001340117 A * | 12/2001 |

OTHER PUBLICATIONS

International Search Report dated Oct. 12, 2009, for French Application 0951999.

* cited by examiner

*Primary Examiner* — Winnie Yip
(74) *Attorney, Agent, or Firm* — Barnes & Thornburg LLP

(57) ABSTRACT

A sunshade includes a shaft supporting a set of umbrella ribs mounted for movement on the shaft between opened and closed positions. The sunshade further includes a cloth coupled to the umbrella ribs for movement therewith relative to the shaft to provide a protective cover in the opened position of the set of umbrella ribs.

26 Claims, 7 Drawing Sheets

FIG. 2
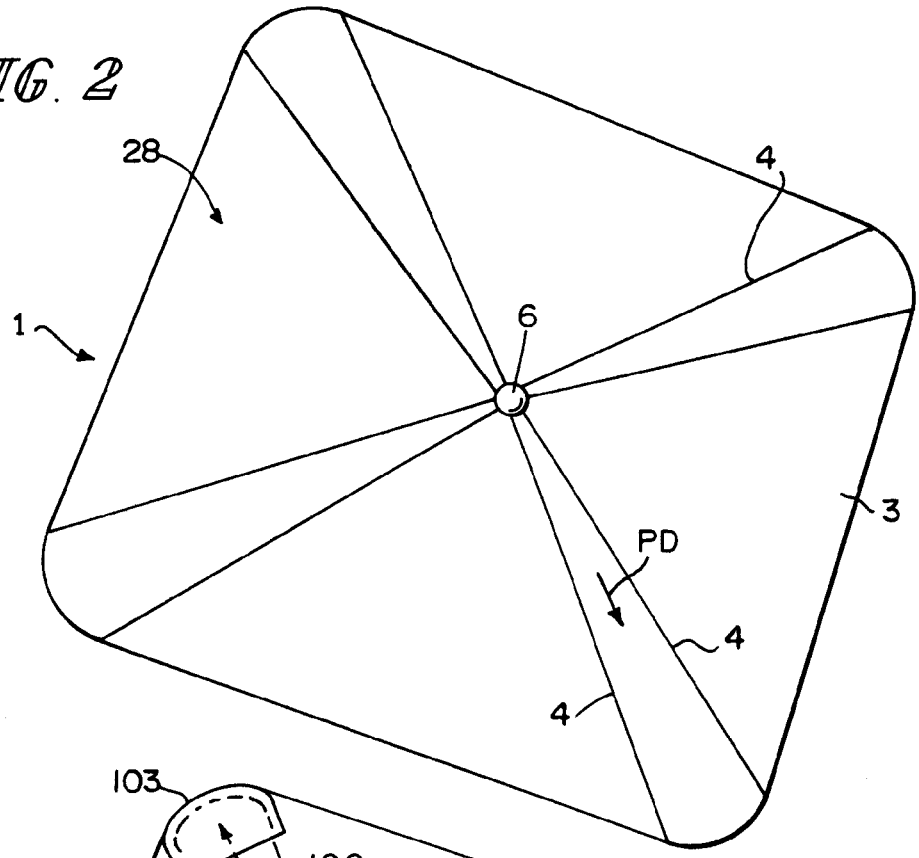
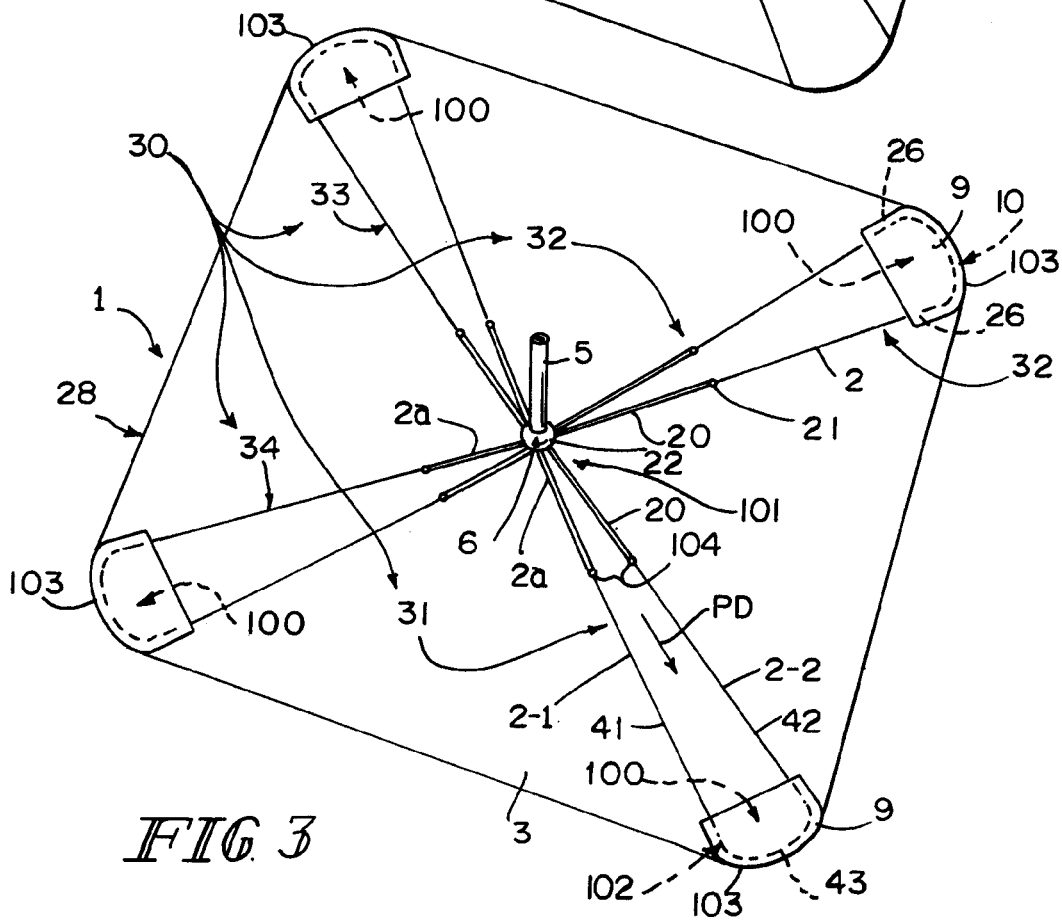
FIG. 3

FIG. 11
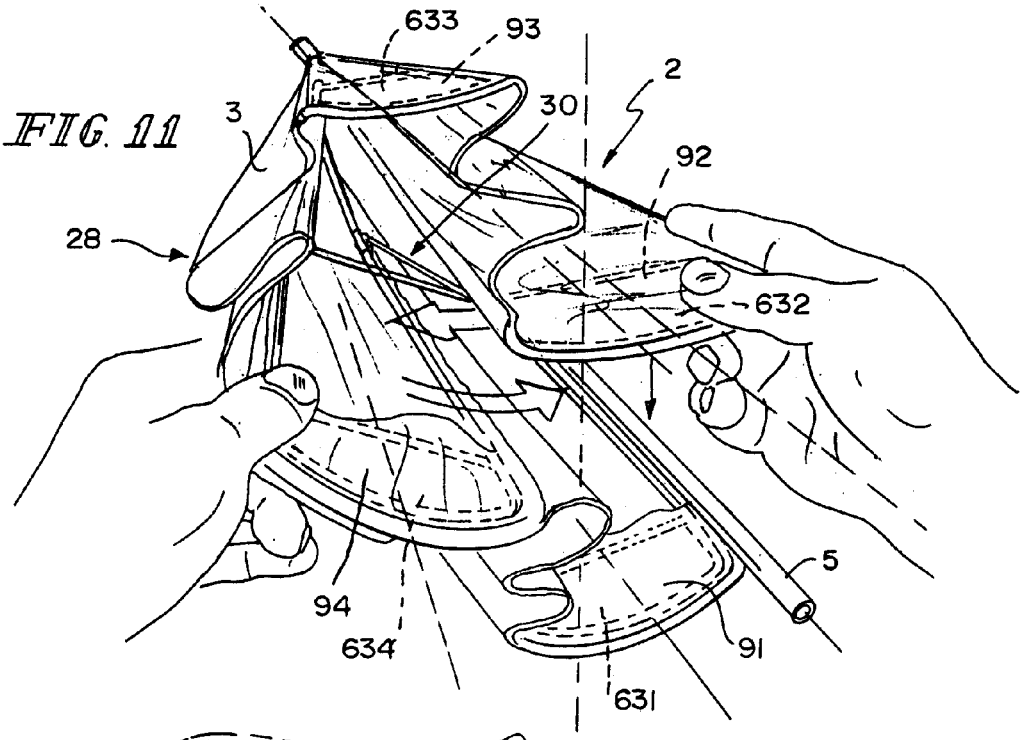
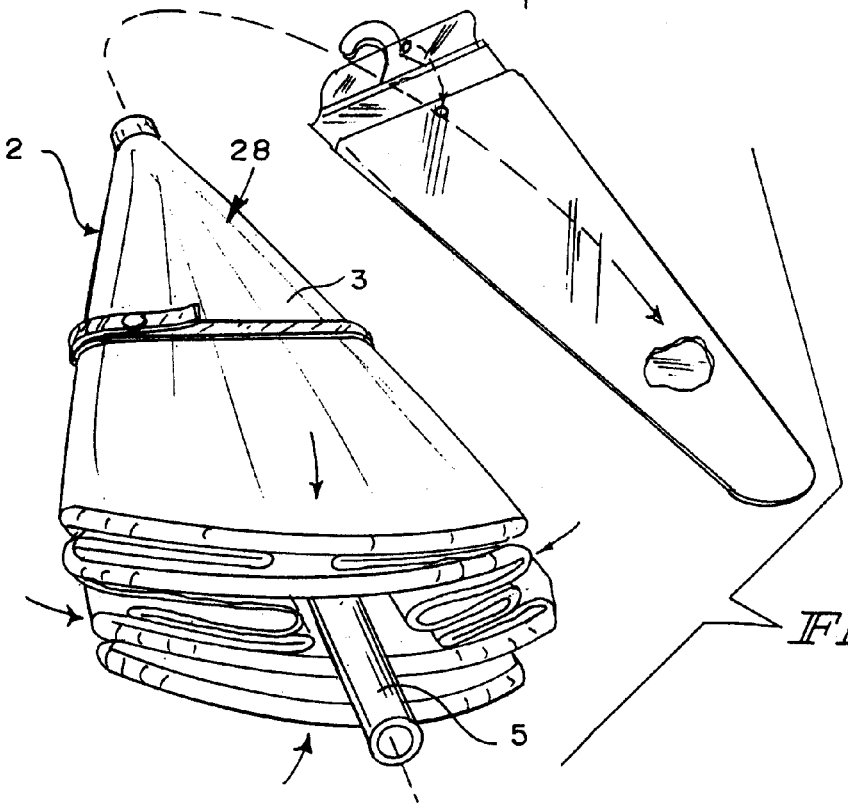
FIG. 12

SUNSHADE

PRIORITY CLAIM

This application claims priority to French Patent Application No. 0951999, filed Mar. 30, 2009.

BACKGROUND

This present disclosure relates to devices for protection against the sun or inclement weather, such as sunshades, for example, sunshades for strollers or other child care equipment, umbrellas, or parasols.

In the field of the present disclosure, there are many types of parasols, umbrellas, or sunshades, each of these devices comprising generally a cloth, a shaft, and umbrella ribs. In position of use, the umbrella ribs are generally separated from one another and make it possible to stretch the cloth when the sunshade is unfolded.

Sunshades are in general able to occupy an unfolded position of use and a folded storage position. The storage position is often compact around the shaft of the sunshade. The shaft is even sometimes telescopic in order to further improve the compactness of the sunshade in storage position.

SUMMARY

A sunshade in accordance with the present disclosure includes a canopy and a central pole under the canopy. The canopy includes a fabric cover and a frame coupled to the central pole and to the canopy. The frame is movable relative to the central pole between collapsed and expanded positions to furl and unfurl the fabric cover.

In illustrative embodiments, the frame includes four fabric-support branches. Each branch widens along its length in a direction away from the central pole. Each branch includes a pair of ribs that are arranged to lie in diverging relation to one another as they extend away from the central pole and a relatively wide laterally extending rib spreader coupled to outer ends of the ribs. The rib spreader includes an outwardly presented exterior edge having a convex shape and lying along and in substantially coextensive relation with a curved corner segment of a perimeter edge of the fabric cover.

In illustrative embodiments, the canopy further includes several mount portions coupled to an underside of the fabric cover along the perimeter edge thereof. Each mount portion cooperates with the fabric corner to form a pocket receiving therein the relatively wide rib spreader of one of the fabric-support branches. Each rib spreader is constrained to remain in its companion pocket in each of the collapsed and expanded positions of the frame and during movement of the frame relative to the central pole between the collapsed and expanded positions.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 2 is a top diagrammatical perspective view, in perspective, of an example of a sunshade according to the present disclosure in an unfolded position;

FIG. 3 is a bottom diagrammatical perspective view, in perspective, of the sunshade in FIG. 2, in the unfolded position;

FIG. 11 is a perspective view showing how a user can fold and interleave the four fabric-support branches to enhance the compactness of the sunshade when folded fully;

FIG. 12 is a perspective view similar to FIG. 11 showing a fully folded sunshade in accordance with the present disclosure prior to insertion of the sunshade into a sunshade-carrier package.

DETAILED DESCRIPTION

Figure 1:
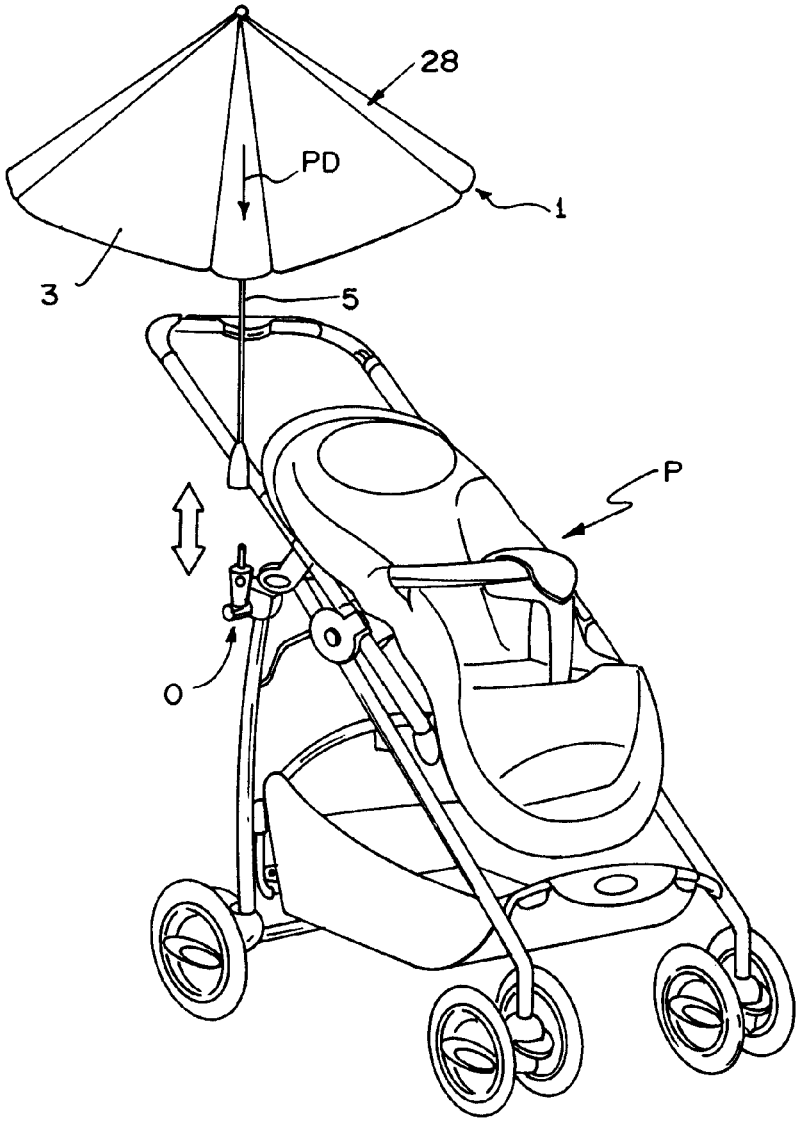
FIG. 1 shows diagrammatically a stroller whereon has been fixed a sunshade in accordance with the present disclosure.

A stroller P whereon has been fixed, for example, by clipping according to the double arrow, a sunshade 1 in accordance with the present disclosure is shown as suggested in FIG. 1. A fastening member O is coupled to stroller P and configured to mate with sunshade 1 to support sunshade 1 on stroller P as suggested in FIG. 1. Any other system of fastening the sunshade on the stroller can be considered and is within the scope of the present disclosure. Closure, folding, and storage of an illustrative sunshade 201 in accordance with the present disclosure is shown, for example, in FIGS. 10-13.

In FIG. 2, the sunshade 1 is shown in a position of use and unfolded. The sunshade 1 comprises a plurality of umbrella ribs 2 that can be seen in FIG. 3 and a protective cloth 3 made in an illustrative example from fabric. Cloth 3 is arranged to cover the umbrella ribs 2 of a first side corresponding to the top of the sunshade, in the example shown in FIGS. 1-3.

The cloth 3 comprises seams 4 made on umbrella ribs 2, along the latter. The umbrella ribs 2 are indeed not able to be seen directly in FIG. 2, but covered by the cloth 3. The umbrella ribs 2 can be seen in FIG. 3. The umbrella ribs 2 can be made from a metal material, plastic, fiberglass, composite, or other suitable material.

The sunshade 1 further comprises central pole or shaft 15 that can be seen in FIG. 3. For reasons of clarity in the drawing, the shaft 5 has been shown partially truncated. The shaft 5 provides a handle grip at a lower end thereof and comprises, at an upper end thereof, a top 6 wherein are fixed first ends 2*a* of the umbrella ribs 2 and also the cloth 3 in such a way as to maintain it stretched against the umbrella ribs 2 in the vicinity of the first ends 2*a* of the umbrella ribs 2. In an embodiment not shown, the top 6 can be located beyond the first ends 2*a* of the umbrella ribs 2, in which case the first ends 2*a* of the umbrella ribs 2 are fixed directly in the body of the shaft 5 and not on the top 6 of the shaft 5.

Figure 8:
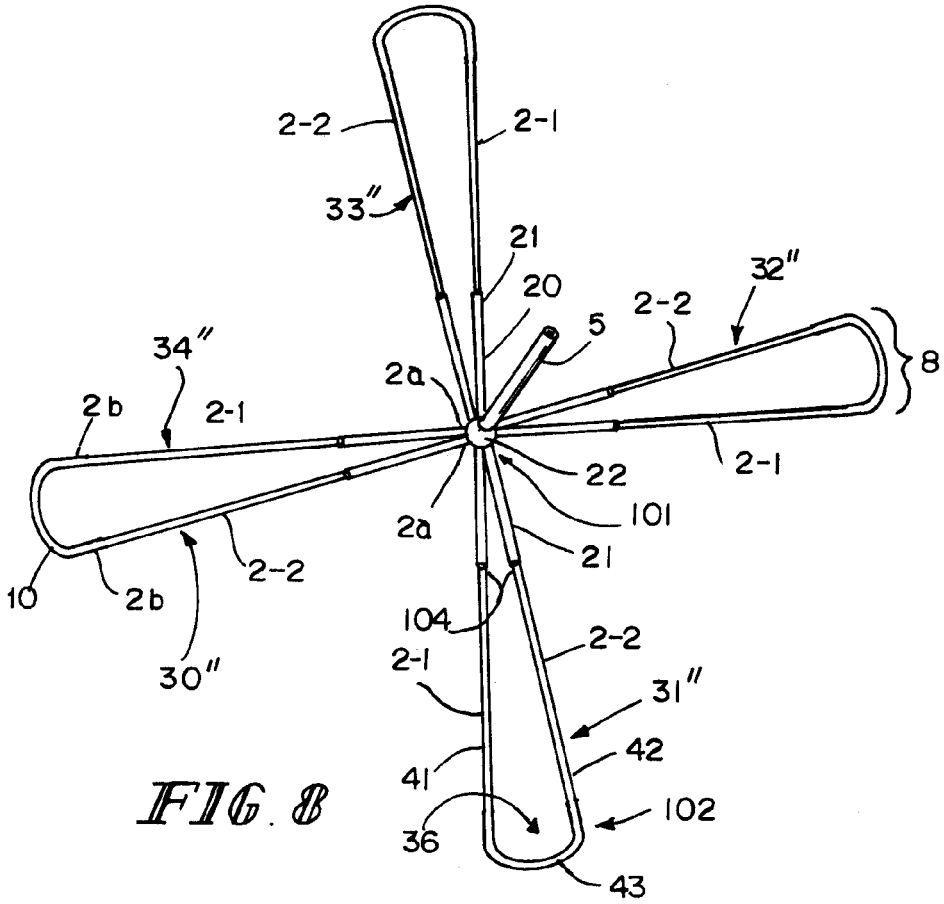
FIG. 8 is a bottom diagrammatical view in perspective of another example of a sunshade devoid of cloth.
Figure 9:
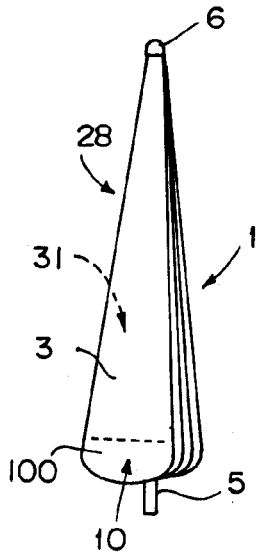
FIG. 9 shows diagrammatically and in perspective an example of a sunshade according to the present disclosure shown in the folded position.

The sunshade 1 can have an unfolded use position as suggested in FIGS. 1-3 or a folded storage position as described further on with regards to FIG. 9. The folding and the unfolding of the sunshade 1 can take place thanks to the presence on the sunshade 1 of counter-umbrella ribs 20 suggested in FIGS. 3, 4, 6, and 8 and shown in more detail in FIG. 10. Each counter-umbrella rib 20 comprises an end 21*a* which is articulated relatively to a corresponding umbrella rib 2 and another end 21*b* which is fixed on a ring 22 sliding along the shaft 5 between the folded use position and the unfolded storage position, in order to allow for the reconfiguration of the sunshade 1 from one position to the other. Any suitable counter-umbrella ribs 20 and sliding ring 22 can be included in sunshade 1. As suggested in FIG. 10, a spring-loaded detent 23 included in sliding ring 22 can engage an aperture 25 formed in shaft 5 to retain a frame 30 comprising all of umbrella ribs 2 and counter-umbrella ribs 20 in an expanded position.

Figure 4:
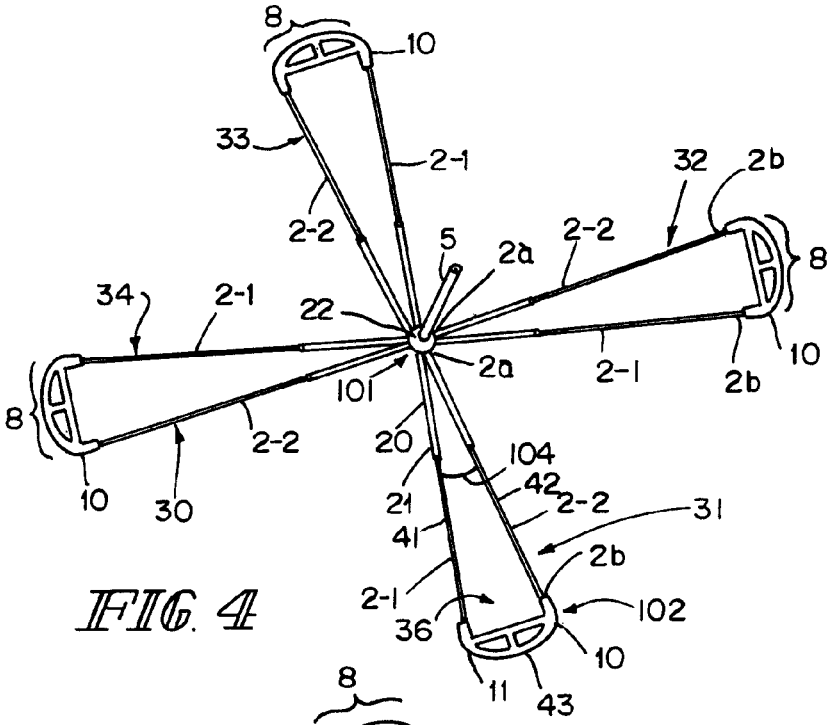
FIG. 4 is a bottom diagrammatical perspective view of an example of a sunshade, in accordance with the present disclosure, devoid of cloth and in the unfolded position.

The umbrella ribs 2 each comprise, in addition to the first end 2*a*, a second end 2*b* that can be seen in FIG. 4, for example. The umbrella ribs 2 are arranged around the shaft 5 by pairs 8, i.e., two by two, being closer to one another in a pair 8 than to any other umbrella rib 2, in particular, another adjacent umbrella rib 2 as suggested in FIG. 4.

The umbrella ribs 2 of a pair 8 are connected by their second ends 2*b* using a junction element 10 with which they cooperate and which makes possible at the same time to connect the second ends 2*b* of the umbrella ribs 2 of a same pair 8 and to maintain the latter separated, whether the sunshade 1 is in unfolded or folded position, where applicable. The number of junction elements 10 in a sunshade 1 in accordance with the present disclosure can be equal to the number of pairs of umbrella ribs 2, as in the example shown in FIG. 4.

As can be seen in FIG. 3, the cloth 3 comprises a mount portion 9 covering, in particular, a corner portion of a second side corresponding to the bottom of the sunshade 1 and the second ends 2*b* of the umbrella ribs 2 as well as the junction element 10. This mount portion 9 can make it possible to fasten the cloth 3 with the second ends 2*b* of the umbrella ribs 2 of a pair 8, for example, in such a way as to maintain the entire junction element 10 and the second ends 2*b* and as such minimize the likelihood, for example, that a child will unfasten the cloth 3 from the junction element 10 of the umbrella ribs 2. The presence of this mount portion 9 of cloth 3 can also contribute to the aesthetic aspect of the sunshade 1.

The junction element 10 comprises an added part 11 or 11' that is provided in addition to each of the ribs 2 as shown in FIGS. 4-7. Junction element 10 is configured to interconnect second ends 2*b* of adjacent umbrella ribs 2 as suggested in FIGS. 4, 6, and 10.

Figure 5:
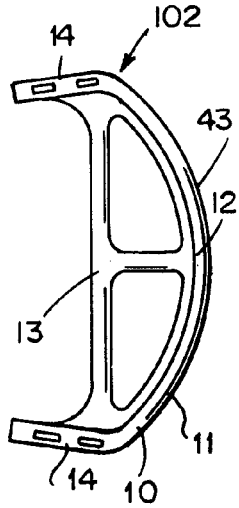
FIG. 5 shows, in a diagrammatical and isolated manner, a junction element making it possible to interconnect the umbrella ribs of a pair of umbrella ribs of the sunshade in FIG. 4.

In this case, the junction element 10 can, as can be seen in FIGS. 4 and 5, comprise an added part 11 comprising a molded plastic part having a convex side 12, in particular rounded, two ends 14 consisting in the example shown of tubular portions located in the extension of the side 12, and an interior structure 13, cut out in the form of a T in the example shown, maintaining the two tubular portions 14 separated. The form of the interior structure 13 could be solid or have another form without leaving the scope of the present disclosure. The ends 14 are intended to be fixed, in particular threaded in the example shown, on companion umbrella ribs 2. As can be seen in FIG. 4, the junction element 10 makes it possible to connect together the second ends 2*b* of the umbrella ribs 2 of the same pair 8, whether the sunshade 1 is in unfolded or folded position, where applicable.

Figure 6:
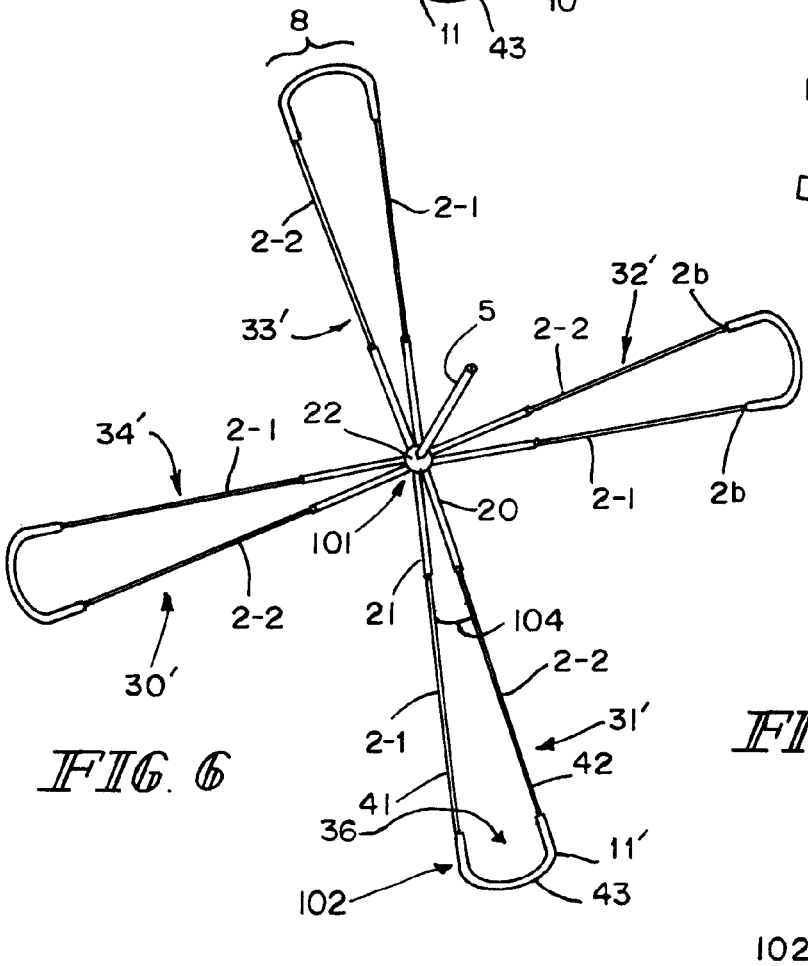
FIG. 6 is a bottom diagrammatical view in perspective of another example of a sunshade devoid of cloth.
Figure 7:
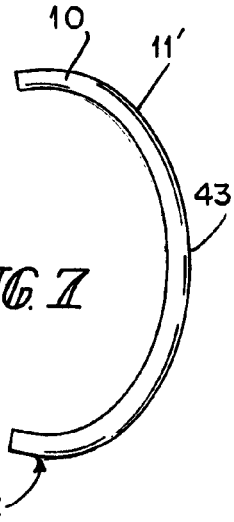
FIG. 7 shows, in a diagrammatical and isolated manner, a junction element used to interconnect the umbrella ribs of a pair of umbrella ribs of the sunshade in FIG. 6.

Another example of a junction element 10 comprises an added part 11' in addition to companion ribs 2 and has been shown, for example, in the FIGS. 6 and 7. This added part 11' is a rod in the form of a U of which can be threaded the two tubular ends on the second ends 2*b* of the umbrella ribs 2 of the same pair 8 in such a way as to connect the latter and to maintain them separated, at a distance from one another, whether the sunshade 1 is in unfolded of folded position, where applicable. The rod 11' shown in FIG. 7 can also have, when not assembled with the umbrella ribs 2, a rectilinear form, being for example made of flexible material that can take the form of a U when assembled with the umbrella ribs 2. The rod 11' of FIG. 7 could, in an alternative not shown, comprise ends formed of blind holes making possible the assembly with the second ends 2*b* of the umbrella ribs 2, the rest of the rod 11' being, for example, solid and not hollow. The rod-defining junction element 10 could, in an embodiment not shown, comprise a spring.

In the case where the junction element 10 comprises an added part in addition to a pair of companion ribs 2, the latter can consist of a part made of a plastics material such as an elastomer, a metal material, or a relatively rigid fabric, or other suitable material. In another embodiment shown in FIG. 8, the junction element 10 is formed of a single (i.e., monolithic) part with the umbrella ribs 2 of the same pair 8.

The sunshade of FIGS. 2 and 3 is shown in a folded storage position in FIG. 9. As can be seen in FIG. 9, the pairs 8 of umbrella ribs 2 are stacked on top of each other when the sunshade 1 is in folded position, which makes it possible to obtain a flat folding.

In the examples shown, the total number of umbrella ribs 2 is equal to eight and the umbrella ribs 2 all have a substantially equal length, in such a way that the general form of the sunshade 1 is substantially square. It is within the scope of the present disclosure to provide the umbrella ribs 2 with unequal lengths in such a way, for example, as to obtain the general form of a parallelogram such as a rectangle for the sunshade 1 and/or if the total number of umbrella ribs 2 is different from eight, being, however, of an even number in such a way as to be able to connect the umbrella ribs 2 two by two. For example, the total number of umbrella ribs 2 can be greater than or less than eight, for example, be equal to six, in which case the sunshade 1 has a generally triangular form.

The present disclosure is of course not limited to the examples that have just been described. In particular, the present disclosure is not limited to sunshades 1 but to any type of device for protection against the sun and inclement weather, for example, a sunshade, an umbrella, a parasol, or other shield.

According to an aspect of the present disclosure, the sunshade 1 comprises at least one junction element 10 cooperating with one of the pairs 8 of umbrella ribs 2. One of the junction elements 10 is configured to connect the second ends 2*b* of the umbrella ribs 2 of each pair 8 and maintain at a distance from one another the second ends 2*b* of the umbrella ribs 2 of that pair 8. The distance between the second ends 2*b* of the umbrella ribs 2 of a pair 8 can, for example, be maintained, whether the sunshade 1 is in unfolded use position or in the folded storage position. In another illustrative embodiment (not shown), the distance between the second ends 2*b* of the umbrella ribs 2 of a pair 8 may not be maintained in folded storage position.

As used herein, the expression "at least one portion of the umbrella ribs being grouped by pairs" means that two adjacent umbrella ribs 2 are located at a short distance in relation to one another in relation to the distance that separates each one of them from any other umbrella rib 2 of the sunshade 1. It can further be said (in reference to FIG. 4) that the distance between a first umbrella rib 2-1, at a point of the latter possibly not located in the vicinity of the first end 2*a* of this umbrella rib 2-1, and the second umbrella 2-2 rib of the same pair 8 (e.g., fabric-support branch 31) is less than the distance between the first umbrella rib 2-1 and an adjacent umbrella rib 2-1 included in an adjacent fabric-support branch 32 and separate from the second umbrella rib 2-2 included in fabric-support branch 31.

The link between the first end 2*a* of an umbrella rib 2 and the shaft 5 can be direct or indirect within the scope of the present disclosure. This link is able, for example, to be made by the intermediary of a part.

The sunshade 1 can comprise, in addition to the umbrella ribs 2 grouped by pairs 8, one or several umbrella ribs 2 that are solitary or isolated. In this case, the total number of umbrella ribs 2 can be even or odd, according to the number of isolated umbrella ribs 2. When the sunshade 1 does not comprise isolated umbrella ribs 2, but only umbrella ribs 2 distributed in pairs 8, the number of umbrella ribs 2 is even. This structure can make possible, in addition to the advantages already listed, an original and effective folding of the sunshade, wherein the various pairs 8 of umbrella ribs 2 are stacked one in relation to the other.

According to an embodiment of the present disclosure, the junction element 10 can comprise an added part in addition to the companion two ribs 2. In this case, the added part can be arranged in such a way as to be fixed, for example, to thread onto each of the second ends 2*b* of the umbrella ribs 2 of the pair 8. In this case, the added part can comprise two hollow tubes arranged in order to thread around each of the second ends 2*b* of the umbrella ribs 2 according to a tube-in-tube link. Any other type of link for the fastening of the added part on the second ends 2*b* of the umbrella ribs 2 can be considered, the fastening not being limited to a tube-in-tube link. Other examples of fastening that can be considered can be selected from the following: crimping, gluing, overmolding, or an other type of mechanical assembly.

The junction element 10, in particular the added part, can have a convex form, in particular rounded, in such a way that the second ends connected by the added part form a convex angle, in particular, rounded of the sunshade. The added part can comprise a plastics material, in particular, a polymer, such as polypropylene, polyethylene, or a thermoplastic material. The added part can comprise alternatively a rod, in particular a rod made of metal, elastomer, or a sufficiently rigid fabric, among others.

According to another aspect of the present disclosure, the junction element 10 can be made from a single part with the umbrella ribs 2 of a pair 8 forming, for example, a convex angle, for example, rounded, of the sunshade 1. The umbrella ribs 2 can comprise a metal material, plastic, fiberglass, a composite material, or other. The total number of umbrella ribs 2 can be equal to eight.

The umbrella ribs 2 can have lengths that are substantially equal to each other in such a way that the general form of a sunshade 1, excluding possibly rounded angles, can be a square. The square form can make it possible, in relation to a sunshade of generally circular form, to enlarge the protection surface, the circle of known sunshades able to be inscribed in the square of the sunshade according to the present disclosure. The umbrella ribs 2 can have, alternatively, lengths that are not equal to each other in such a way that the general form of a sunshade, excluding possibly rounded angles, can be a parallelogram such as a rectangle.

Sunshade 1 includes a canopy 28 and a central pole 5 under canopy 28 as suggested in FIGS. 1 and 3. Canopy 28 includes a frame 30 mounted for movement relative to central pole 5 between collapsed and expanded positions and a fabric cover 3 coupled to frame 30 to move therewith relative to central pole 5 as suggested in FIGS. 1-3, 9, and 10.

Frame 30 includes several fabric-support branches 31-34 arranged to underlie and support fabric cover 3 in canopy 28 and to extend outwardly away from central pole 5 upon movement of frame 30 to the expanded position as suggested in FIG. 3. Fabric-support branches 31-34 are configured to be moved in inward directions A-D by a user during furling of fabric cover 3 as suggested in FIGS. 10 and 11 to lie generally along the length of central pole 5 when frame 30 is moved relative to central pole 5 to assume the collapsed position as suggested in FIGS. 9 and 13.

Figure 10:
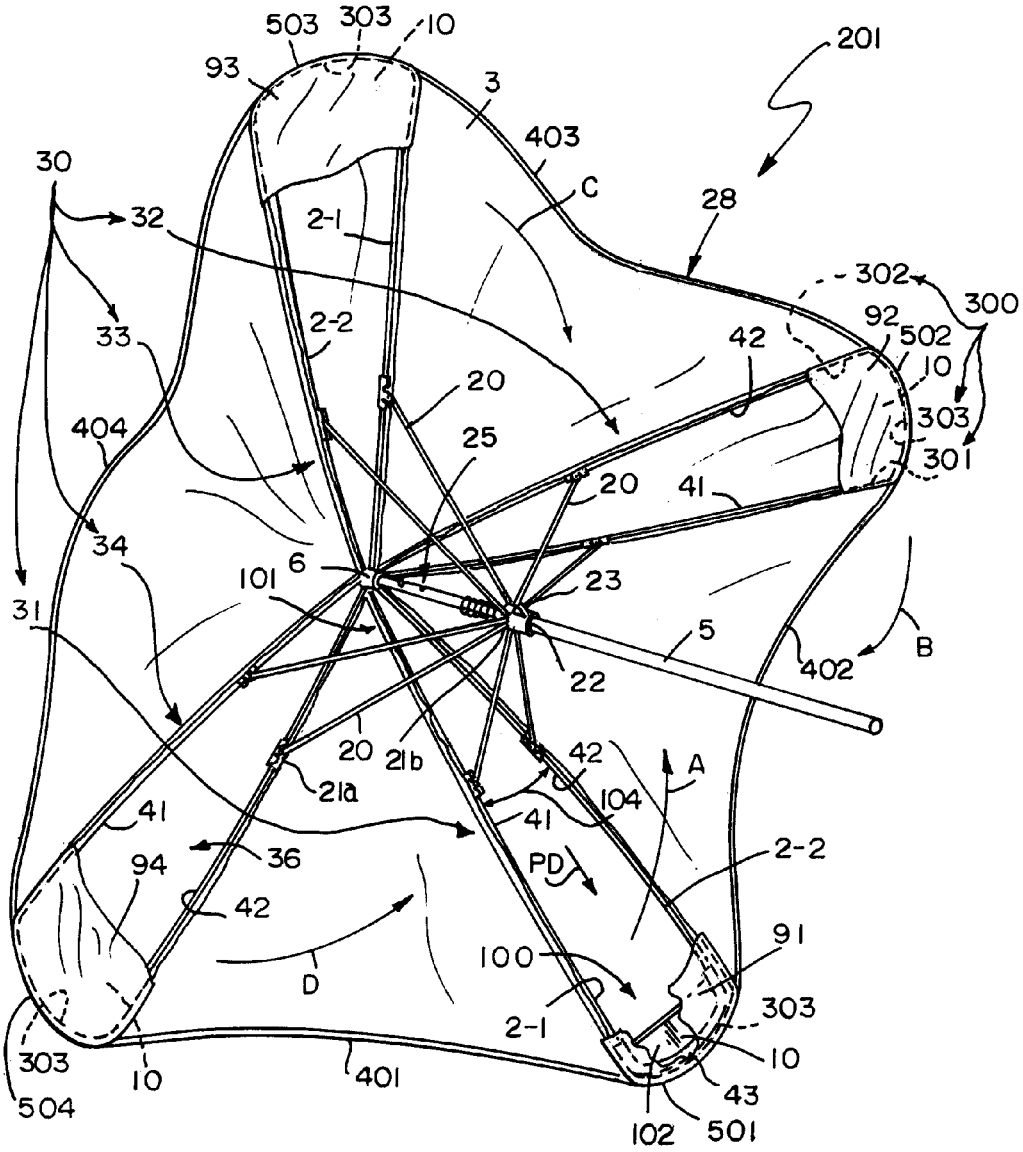
FIG. 10 is a perspective view of a partly closed sunshade in accordance with the present disclosure suggesting a pattern of movement of laterally extending rib expanders in each of four fabric-support branches during furling of the fabric cover and movement of the frame underlying the fabric cover to assume a collapsed position.

A frame 30 in accordance with the present disclosure is shown diagrammatically in FIG. 3 and illustratively in FIG. 10. Frame 30 includes fabric-support branches 31-34. One alternative frame 30' within the scope of the present disclosure includes fabric-support branches 31'-34' and is shown, for example, in FIG. 4. Another alternative frame 30" includes fabric-support branches 31"-34" and is shown, for example, in FIG. 6.

Frame 30 also includes a slide 22 mounted for back-and-forth sliding movement on central pole 5 and several sets of counter-umbrella ribs 20 as shown, for example, in FIG. 10. Ribs 20 are arranged in pairs and each pair is coupled to slide 22 and to one of fabric-support branches 31-34.

Each of fabric-support branches 31-34 includes an inner root portion 101 and an outer distal portion 102 as suggested in FIGS. 3 and 4. Inner root portion 101 is arranged to lie in close proximity to central pole 5 in each of the collapsed and expanded positions of frame 30 and configured to have a narrow lateral width as suggested in FIGS. 4 and 10. Outer distal portion 102 is arranged to lie in close proximity to central pole 5 upon movement of frame 30 to assume the collapsed position and in spaced-apart relation to central pole 5 upon movement of frame 30 to assume the expanded position. Outer distal portion 102 is configured to have a relatively wider lateral width as compared to the narrow lateral width of inner root portion 101 as suggested in FIGS. 4 and 10. Outer distal portion 102 of each fabric-support branch 31-34 is coupled to canopy 28 at an outer perimeter portion 103 thereof as shown, for example, in FIGS. 3 and 10.

Each of fabric-support branches 31-34 includes outwardly presented first and second exterior edges 41, 42 as shown, for example, in FIGS. 3, 4, and 10. First exterior edge 41 extends along a first side thereof between inner root portion 101 thereof and outer distal portion 102. Second exterior edge 42 extends along an opposite second side thereof between inner root portion 101 thereof and outer distal portion 102 thereof. The outwardly presented first and second exterior edges 41, 42 are arranged to diverge from one another in a polar direction PD extending away from inner root portion 101 thereof toward outer distal portion 102 thereof as suggested in FIGS. 1-3 and 10.

Frame 30 further includes a rib mount 6 coupled to central pole 5 as shown best in FIG. 10. Each of the fabric-support branches 31-34 includes a first rib 2-1, a second rib 2-2, and a laterally extending rib spreader 10 (e.g., rib spreader 11 of FIG. 5, rib spreader 11' of FIG. 7, rib spreader 11" of FIG. 8, or rib spreader 11'" of FIGS. 10-13). First rib 2-1 is coupled at a first end thereof to rib mount 6 and configured to include the outwardly presented first exterior edge 41 as suggested in FIGS. 3 and 10. Second rib 2-2 is coupled at a first end thereof to rib mount 6 and configured to include the outwardly presented second exterior edge 42 as also suggested in FIGS. 3 and 10. Second rib 2-2 is arranged to cooperate with first rib 2-1 to define an acute included angle 104 therebetween that is unchanged during movement of frame 30 between the collapsed and expanded positions. Laterally extending rib spreader 10 is coupled to first and second ribs 2-1 and 2-2 to locate first and second ribs 2-1 and 2-2 between rib mount 6 coupled to central pole 5 and laterally extending rib spreader 10. In illustrative embodiments, the measure of acute included angle 104 is about 20-25 degrees.

Laterally extending rib spreader 10 is configured to include an outwardly presented convex exterior edge 43 arranged to face away from central pole 5 upon movement of frame 30 to the expanded position as suggested in FIGS. 3 and 4. Outwardly presented convex exterior edge 43 is curved in illustrative embodiments as suggested in FIGS. 5, 6, 8, and 10. Outwardly presented convex exterior edge 43 is arranged to interconnect the outwardly presented first and second exterior edges 41, 42 as suggested in FIGS. 4 and 10.

Laterally extending rib spreader 10 is coupled to free second ends of each of the first and second ribs 2-1 and 2-2 to spread the first and second ribs 2-1 and 2-2 and establish the measure of acute included angle 104 as suggested in FIGS. 4-7 and 10. Any suitable means may be used to couple laterally extending rib spreader 11 (shown in FIG. 5) or spreader 11' (shown in FIG. 7) to first rib 2-1 and second rib 2-2.

First and second ribs 2-1 and 2-2 and the laterally extending rib spreader 10 (11") included in each of fabric-support branches 31"-34" of frame 30" cooperate to form a monolithic element as suggested in FIG. 8. As suggested in FIG. 8, a rod or tube made of a plastics material, a metal material, or other suitable material is shaped using any suitable means to form a loop to provide one of the fabric-support branches 31"-34".

First and second ribs 2-1 and 2-2 are arranged to lie in spaced-apart relation to one another to form an opening 36 therebetween as suggested in FIG. 4. Fabric cover 3 included in canopy 28 is coupled to first and second ribs 2-1 and 2-2 and arranged to cover opening 36 between first and second ribs 2-1 and 2-2. Canopy 28 further includes a mount portion 9 coupled to an underside of fabric cover 3 to form a spreader-receiving pocket 100 therebetween as suggested in FIG. 3. Each laterally extending rib spreader 10 is located in a companion one of the spreader-receiving pockets 100 to remain therein during movement of frame 30 between the collapsed and expanded positions as suggested in FIGS. 3 and 9. In illustrative embodiments, a mount portion 9 is provided for each fabric-support branch and there are four separate mount covers 91, 92, 93, and 94 in canopy 28 as shown in FIGS. 3 and 10.

Mount portion 9 and fabric cover 3 cooperate to form an inner seam 300 therebetween having a concave segment 303 and communicating with spreader-receiving pocket 100 as suggested, for example, in FIG. 10. Laterally extending rib spreader 10 includes an outwardly presented convex exterior edge 43 arranged to engage concave segment 303 of inner seam 301 as suggested in FIG. 10. Portions of each of first and second ribs 2-1 and 2-2 are arranged to extend into spreader-receiving pocket 100 through an opening thereof facing toward central pole 5. Fabric cover 3 included in canopy 28 is coupled to first and second ribs 2-1 and 2-2 to cause the laterally extending rib spreader 10 to remain in spreader-receiving pocket 100 during movement of frame 30 between the collapsed and expanded positions.

Canopy 28 illustratively includes several (e.g., four) mount portions 91, 92, 93, and 94 coupled to an underside of fabric cover 3. Fabric-support branches 31-34 are arranged to lie in circumferentially spaced-apart relation to one another upon movement of frame 30 to assume the expanded position as suggested in FIGS. 3 and 10. Each mount portion 9 (91-94) cooperates with fabric cover 3 to form therebetween a companion spreader-receiving pocket 100 for receiving therein a companion of the fabric-support branches 31-34 as suggested in FIG. 3. Outer distal portion 102 of each fabric-support branch 31-34 is arranged to lie in and remain in a companion one of the spreader-receiving pockets 10 during movement of frame 30 between the collapsed and expanded positions.

Inner seam 300 includes a first side segment 301 arranged to engage a portion of outwardly presented first exterior edge 41 and an opposing second side segment 302 arranged to engage a portion of outwardly presented second exterior edge 42 as suggested in FIG. 10. Inner seam 300 further includes a concave segment 303 interconnecting the first and second side segments 301, 302 and facing toward central pole 5. Outwardly presented exterior edge 43 of laterally extending rib spreader 10 has a convex shape and is arranged to engage concave segment 303 of inner seam 300 as suggested in FIG. 10.

Fabric cover 3 of canopy 28 includes a perimeter edge having a first straight side segment 401, a second straight side segment 402, and a first curved corner segment 501 configured to have a predetermined arcuate length and arranged to interconnect the first and second straight side segments as suggested in FIGS. 2 and 3. Outer distal portion 102 included in a first fabric-support branch 31 includes an outwardly presented convex edge 43 that is arranged to extend substantially along the predetermined arcuate length of first curved corner segment 501 in each of the collapsed and expanded positions of frame 30.

Fabric cover 3 of canopy 28 further includes a third straight side segment 403 and a second curved corner segment 502 arranged to interconnect second and third straight side segments 402, 403 as suggested in FIGS. 2 and 3. Second fabric-support branch 32 includes an outwardly presented convex edge 43 that is arranged to extend substantially along the predetermined arcuate length of second curved corner segment 502 in each of the collapsed and expanded positions of frame 30.

First and third straight side sections 401, 403 are arranged to lie in substantially spaced-apart parallel relation to one another and in substantially orthogonal relation to second straight side section 402 upon movement of frame 30 to assume the expanded position as shown in FIG. 3. A third fabric-supported branch 33 includes an outwardly presented convex edge 43 that is arranged to extend substantially along the predetermined arcuate length of third curved corner segment 503 in each of the collapsed and expanded positions of frame 30.

Fabric cover 3 of canopy 28 further includes a fourth straight side segment 404 arranged to lie in substantially spaced-apart parallel relation to second straight side segment 402 upon movement of frame 30 to assume the expanded position, a third curved corner segment 503 arranged to interconnect third and fourth straight side segments 403, 404, and a fourth curved corner segment 504 arranged to interconnect fourth and first straight side segments 404, 401. Third fabric-supported branch 33 includes an outwardly presented convex edge 43 that is arranged to extend substantially along the predetermined arcuate length of third curved corner segment 503 in each of the collapsed and expanded positions of frame 30. Fourth fabric-support branch 34 includes an outwardly presented convex edge 43 that is arranged to extend substantially along the predetermined arcuate length of fourth curved corner segment 504 in each of the collapsed and expanded positions of frame 30.

In illustrative embodiments, a mount portion 9 is provided for each of the fabric-support branches 31-34. As suggested in FIGS. 3 and 10, four mount portions 96-94 are included in canopy 28.

First mount portion 91 is coupled to an underside of fabric cover 3 and arranged to lie adjacent to first curved corner segment 501 as suggested in FIGS. 3 and 10. First mount portion 91 cooperates with fabric cover 3 to provide first pocket means 100 receiving outer distal portion 102 of first fabric-support branch 31 therein in each of the collapsed and expanded positions of frame 30 and during movement of frame 30 between the collapsed and expanded positions.

Second mount portion 92 is coupled to an underside of fabric cover 3 and arranged to lie adjacent to second curved corner segment 502 as suggested in FIGS. 3 and 10. Second mount portion 92 cooperates with fabric cover 3 to provide second pocket means 100 receiving outer distal portion 102 of second fabric-support branch 32 therein in each of the collapsed and expanded positions of frame 30 and during movement of frame 30 between the collapsed and expanded positions, Third mount portion 93 is coupled to an underside of fabric cover 3 and arranged to lie adjacent to third curved corner segment 503 as suggested in FIGS. 3 and 10. Third mount portion 93 cooperates with fabric cover 3 to provide third pocket means 100 receiving outer distal portion 102 of third fabric-support branch 33 therein in each of the collapsed and expanded positions of frame 30 and during movement of frame 30 between the collapsed and expanded positions.

Fourth mount portion 94 is coupled to an underside of fabric cover 3 and arranged to lie adjacent to fourth curved corner segment 504 as suggested in FIGS. 3 and 10. Fourth mount portion 94 cooperates with fabric cover 3 to provide fourth pocket means 100 receiving outer distal portion 102 of fourth fabric-support branch 34 therein in each of the collapsed and expanded positions of frame 30 and during movement of frame 30 between the collapsed and expanded positions.

First mount portion 901 and fabric cover 3 cooperate to form an inner seam 300 therebetween and outwardly presented convex edge 43 of outer distal portion 102 included in first fabric-support branch 31 is arranged to engage inner seam 300. Inner seam 300 includes a concave segment 303 arranged to extend along the predetermined arcuate length of first curved corner segment 501 and to engage outwardly presented convex edge 43 of outer distal portion 102 included in first fabric-support branch 31. Inner seam 300 includes a first side segment 301 arranged to cooperate with first straight side segment 401 to form an acute included angle 601 therebetween and a second side segment 301 arranged to cooperate with second straight side segment 402 to form an acute included angle 602 therebetween as suggested in FIG. 3. Concave segment 303 is arranged to interconnect first and second side segments 301, 302 of inner seam 300 as suggested in FIG. 10.

Figure 13:
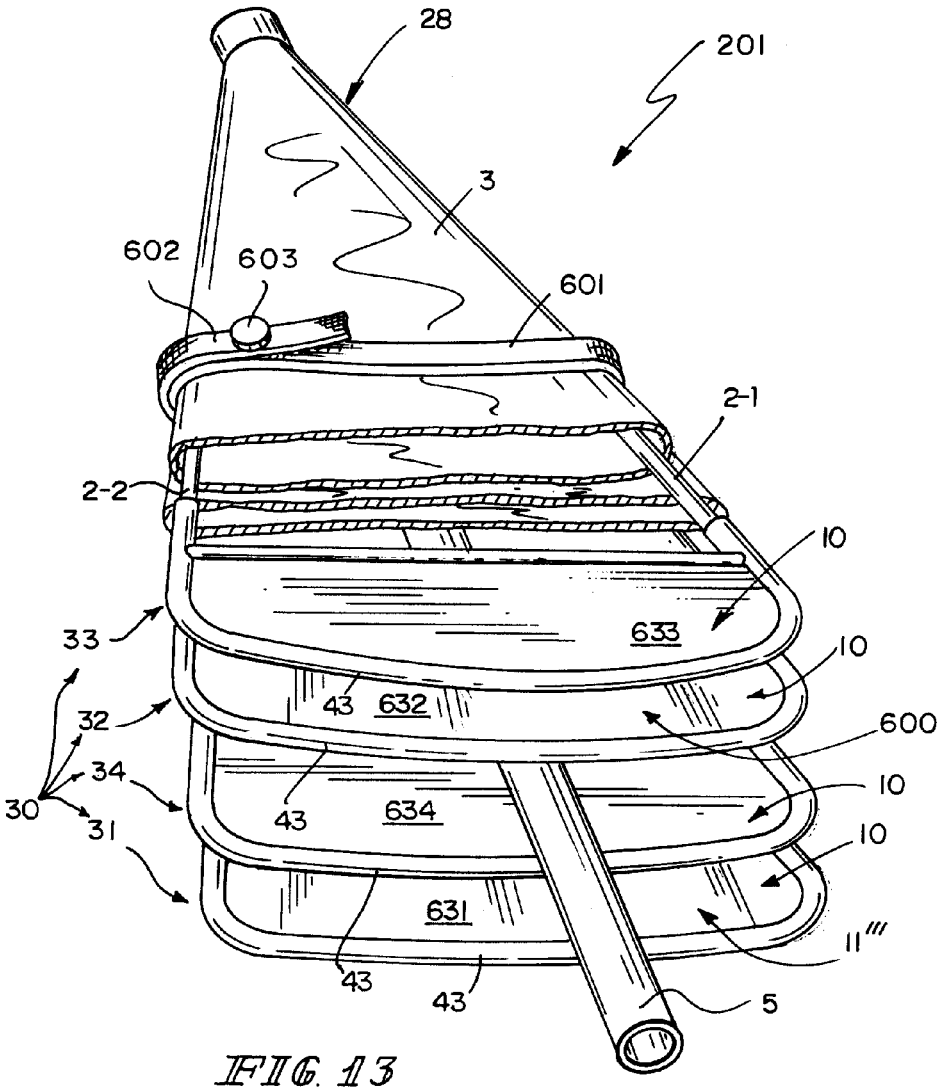
FIG. 13 is a perspective view showing the fully folded sunshade after it has been inserted into the sunshade-carrier package.

In illustrative embodiments of the present disclosure, canopy 28 can be folded as suggested in FIGS. 9-13 to cause first and fourth fabric-support branches 31, 34 to lie on one side of central pole 5 while second and third fabric-support branches 32, 33 lie on an opposite side of central pole 5 as shown best in FIG. 13. When folded as shown, central pole 5 lies in a space 600 provided between second and fourth fabric-support branches 32, 34 as shown, for example, in FIG. 13. Any suitable tie-down means such as straps 601, 602 and fastener 603 can be provided to retain canopy 28 in the folded condition as suggested in FIGS. 12 and 13.

In the embodiment shown in FIG. 10, each of fabric-support branches 31-34 includes a substantially flat panel 631, 632, 633, 634 at its outer distal portion 102 as suggested in FIG. 13. When canopy 28 is folded, these panels 631-634 are arranged to lie in stacked substantially parallel relation to one another to enhance a flatness characteristic of folded canopy 28 as shown, for example, in FIGS. 12 and 13.

The invention claimed is:

1. A sunshade comprising a canopy and a central pole under the canopy, the canopy including a frame mounted for movement relative to the central pole between collapsed and expanded positions and a fabric cover coupled to the frame to move therewith relative to the central pole, wherein the frame includes several fabric-support branches arranged to underlie and support the fabric cover in the canopy and to extend outwardly away from the central pole upon movement of the frame to the expanded position, each fabric-support branch includes an inner root portion arranged to lie in close proximity to the central pole in each of the collapsed and expanded positions of the frame and configured to have a narrow lateral width and an outer distal portion arranged to lie in close proximity to the central pole upon movement of the frame to assume the collapsed position and in spaced-apart relation to the central pole upon movement of the frame to assume the expanded position, the outer distal portion is configured to have a relatively wider lateral width as compared to the narrow lateral width of the inner root portion, and the outer distal portion of each fabric-support branch is coupled to the canopy at an outer perimeter portion thereof;

wherein each fabric-support branch includes an outwardly presented first exterior edge extending along a first side of each fabric support branch between the inner root portion of each fabric support branch and the outer distal portion of each fabric support branch and an outwardly presented second exterior edge extending along an opposite second side of each fabric support branch between the inner root portion of each fabric support branch and the outer distal portion of each fabric support branch and the outwardly presented first and second exterior edges are arranged to diverge from one another in a polar direction extending away from the inner root portion of each fabric support branch toward the outer distal portion of each fabric support branch;

wherein the frame further includes a rib mount coupled to the central pole and one of the fabric-support branches includes a first rib coupled at a first end thereof to the rib mount and configured to include the outwardly presented first exterior edge, a second rib coupled at a first end thereof to the rib mount and configured to include the outwardly presented second exterior edge and arranged to cooperate with the first rib to define an acute included angle therebetween that is unchanged during movement of the frame between the collapsed and expanded positions, and the outer distal portion of each fabric-support branch having a laterally extending rib spreader coupled to the first and second ribs to locate the first and second ribs between the rib mount coupled to the central pole and the laterally extending rib spreader; and wherein the canopy further includes a mount portion coupled to an underside of the fabric cover to form a spreader-receiving pocket therebetween and the laterally extending rib spreader is located in the spreader-receiving pocket to remain therein during movement of the frame between the collapsed and expanded positions, the mount portion and the fabric cover cooperate to form an inner seam therebetween having a concave segment and communicating with the spreader-receiving pocket and the laterally extending rib spreader includes an outwardly presented convex exterior edge arranged to engage the concave segment of the inner seam.

2. The sunshade of claim 1, wherein a measure of the acute included angle is about 22 degrees.

3. The sunshade of claim 1, wherein the laterally extending rib spreader is configured to include the outwardly presented convex exterior edge arranged to face away from the central pole upon movement of the frame to the expanded position.

4. The sunshade of claim 3, wherein the outwardly presented convex exterior edge is curved.

5. The sunshade of claim 3, wherein the outwardly presented convex exterior edge is arranged to interconnect the outwardly presented first and second exterior edges.

6. The sunshade of claim 1, wherein the first and second ribs and the laterally extending rib spreader cooperate to form a monolithic element.

7. The sunshade of claim 1, wherein the laterally extending rib spreader is coupled to free second ends of each of the first and second ribs to spread the first and second ribs and establish a measure of the acute included angle.

8. The sunshade of claim 1, wherein the first and second ribs are arranged to lie in spaced-apart relation to one another to form an opening therebetween and the fabric cover included in the canopy is coupled to the first and second ribs and arranged to cover the opening between the first and second ribs.

9. The sunshade of claim 1, wherein portions of each of the first and second ribs are arranged to extend into the spreader-receiving pocket through an opening thereof facing toward the central pole.

10. The sunshade of claim 1, wherein the fabric cover included in the canopy is coupled to the first and second ribs to cause the laterally extending rib spreader to remain in the spreader-receiving pocket during movement of the frame between the collapsed and expanded positions.

11. The sunshade of claim 1, wherein the canopy further includes several of the mount portions coupled to the underside of the fabric cover, each mount portion cooperates with the fabric cover to form therebetween a companion spreader-receiving pocket for a companion one of the fabric-support branches, and the outer distal portion of each fabric-support branch is arranged to lie in and remain in a companion one of the spreader-receiving pockets during movement of the frame between the collapsed and expanded positions.

12. The sunshade of claim 11, wherein each of the mount portion and the fabric cover cooperate to form an inner seam therebetween communicating with the spreader-receiving pocket and the laterally extending rib spreader includes an outwardly presented exterior edge arranged to engage the inner seam.

13. A sunshade comprising a canopy and a central pole under the canopy, the canopy including a frame mounted for movement relative to the central pole between collapsed and expanded positions and a fabric cover coupled to the frame to move therewith relative to the central pole, wherein the frame includes several fabric-support branches arranged to underlie and support the fabric cover in the canopy and to extend outwardly away from the central pole upon movement of the frame to the expanded position, each fabric-support branch includes an inner root portion arranged to lie in close proximity to the central pole in each of the collapsed and expanded positions of the frame and configured to have a narrow lateral width and an outer distal portion arranged to lie in close proximity to the central pole upon movement of the frame to assume the collapsed position and in spaced-apart relation to the central pole upon movement of the frame to assume the expanded position, the outer distal portion is configured to have a relatively wider lateral width as compared to the narrow lateral width of the inner root portion, and the outer distal portion of each fabric-support branch is coupled to the canopy at an outer perimeter portion thereof:

wherein each fabric-support branch includes an outwardly presented first exterior edge extending along a first side of each fabric support branch between the inner root portion of each fabric support branch and the outer distal portion of each fabric support branch and an outwardly presented second exterior edge extending along an opposite second side of each fabric support branch between the inner root portion of each fabric support branch and the outer distal portion of each fabric support branch and the outwardly presented first and second exterior edges are arranged to diverge from one another in a polar direction extending away from the inner root portion of each fabric support branch toward the outer distal portion of each fabric support branch and the outer distal portion of each fabric-support branch having a laterally extending rib spreader coupling the outwardly presented first exterior edge and the outwardly presented second exterior edge;

wherein the canopy further includes several mount portions coupled to an underside of the fabric cover, each mount portion cooperates with the fabric cover to form therebetween a companion spreader-receiving pocket for a companion one of the fabric-support branches, and the outer distal portion of each fabric-support branch is arranged to lie in and remain in a companion one of the spreader-receiving pockets during movement of the frame between the collapsed and expanded positions;

wherein the mount portion and the fabric cover cooperate to form an inner seam therebetween communicating with the spreader-receiving pocket and the laterally extending rib spreader includes an outwardly presented exterior edge arranged to engage the inner seam; and wherein the inner seam includes a first side segment arranged to engage a portion of the outwardly presented first exterior edge and an opposing second side segment arranged to engage a portion of the outwardly presented second exterior edge.

14. The sunshade of claim 13, wherein the inner seam further includes a concave segment interconnecting the first and second side segments and facing toward the central pole and the outwardly presented exterior edge of the laterally extending rib spreader has a convex shape and is arranged to engage the concave segment of the inner seam.

15. A sunshade comprising a canopy and a central pole under the canopy, the canopy including a frame mounted for movement relative to the central pole between collapsed and expanded positions and a fabric cover coupled to the frame to move therewith relative to the central pole, wherein the frame includes several fabric-support branches arranged to underlie and support the fabric cover in the canopy and to extend outwardly away from the central pole upon movement of the frame to the expanded position, each fabric-support branch includes an inner root portion arranged to lie in close proximity to the central pole in each of the collapsed and expanded positions of the frame and configured to have a narrow lateral width and an outer distal portion arranged to lie in close proximity to the central pole upon movement of the frame to assume the collapsed position and in spaced-apart relation to the central pole upon movement of the frame to assume the expanded position, the outer distal portion is configured to have a relatively wider lateral width as compared to the narrow lateral width of the inner root portion, and the outer distal portion of each fabric-support branch is coupled to the canopy at an outer perimeter portion thereof:

wherein each fabric-support branch includes an outwardly presented first exterior edge extending along a first side of each fabric support branch between the inner root portion of each fabric support branch and the outer distal portion of each fabric support branch and an outwardly presented second exterior edge extending along an opposite second side of each fabric support branch between the inner root portion of each fabric support branch and the outer distal portion of each fabric support branch and the outwardly presented first and second exterior edges are arranged to diverge from one another in a polar direction extending away from the inner root portion of each fabric support branch toward the outer distal portion of each fabric support branch and the outer distal portion of each fabric-support branch having a laterally extending rib spreader coupling the outwardly presented first exterior edge and the outwardly presented second exterior edge;

wherein the canopy further includes several mount portions coupled to an underside of the fabric cover, each mount portion cooperates with the fabric cover to form therebetween a companion spreader-receiving pocket for a companion one of the fabric-support branches, and the outer distal portion of each fabric-support branch is arranged to lie in and remain in a companion one of the spreader-receiving pockets during movement of the frame between the collapsed and expanded positions;

wherein the mount portion and the fabric cover cooperate to form an inner seam therebetween communicating with the spreader-receiving pocket and the laterally extending rib spreader includes an outwardly presented exterior edge arranged to engage the inner seam; and wherein the inner seam includes a concave segment facing toward the central pole and the outwardly presented exterior edge of the laterally extending rib spreader has a convex shape and is arranged to engage the concave segment of the inner seam.

16. A sunshade comprising a canopy and a central pole under the canopy, the canopy including a frame mounted for movement relative to the central pole between collapsed and expanded positions and a fabric cover coupled to the frame to move therewith relative to the central pole, wherein the frame includes several fabric-support branches each including an outwardly presented first exterior edge and an outwardly presented second exterior edge being arranged to underlie and support the fabric cover in the canopy and to extend outwardly away from the central pole upon movement of the frame to the expanded position, the fabric cover includes a perimeter edge having a first straight side segment, a second straight side segment, and a first curved corner segment configured to have a predetermined arcuate length and arranged to interconnect the first and second straight side segments, each fabric-support branch includes an inner root portion arranged to lie in close proximity to the central pole in each of the collapsed and expanded positions of the frame and an outer distal portion arranged to lie in close proximity to the central pole upon movement of the frame to assume the collapsed position and in spaced-apart relation to the central pole upon movement of the frame to assume the expanded position, and the outer distal portion included in a first of the fabric-su ort branches includes an outwardly presented convex edge that connects the outwardly presented first exterior edge and the outwardly presented second exterior edge and is arranged to extend substantially along the predetermined arcuate length of the first curved corner segment in each of the collapsed and expanded positions of the frame;

wherein the fabric cover further includes a third straight side segment, a second curved corner segment arranged to interconnect the second and third straight side segments, and a second of the fabric-support branches includes an outwardly presented convex edge that connects the outwardly presented first exterior edge and the outwardly presented second exterior edge and is arranged to extend substantially along the predetermined arcuate length of the second curved corner segment in each of the collapsed and expanded positions of the frame; and wherein the first and third straight side segments are arranged to lie in substantially spaced-apart parallel relation to one another and in substantially orthogonal relation to the second straight side section upon movement of the frame to assume the expanded position and wherein the several fabric-support branches are engaged by the respective curved corner segments and folded one over the other in the collapsed position.

17. The sunshade of claim 16, wherein a third of the fabric-supported branches includes an outwardly presented convex edge that is arranged to extend substantially along the predetermined arcuate length of the third curved corner segment in each of the collapsed and expanded positions of the frame.

18. A sunshade comprising a canopy and a central pole under the canopy, the canopy including a frame mounted for movement relative to the central pole between collapsed and expanded positions and a fabric cover coupled to the frame to move therewith relative to the central pole, wherein the frame includes several fabric-support branches each including an outwardly presented first exterior edge and an outwardly presented second exterior edge arranged to underlie and support the fabric cover in the canopy and to extend outwardly away from the central pole upon movement of the frame to the expanded position, the fabric cover includes a perimeter edge having a first straight side segment, a second straight side segment, and a first curved corner segment configured to have a predetermined arcuate length and arranged to interconnect the first and second straight side segments, each fabric-support branch includes an inner root portion arranged to lie in close proximity to the central pole in each of the collapsed and expanded positions of the frame and an outer distal portion arranged to lie in close proximity to the central pole upon movement of the frame to assume the collapsed position and in spaced-apart relation to the central pole upon movement of the frame to assume the expanded position, and the outer distal portion included in a first of the fabric-support branches includes an outwardly presented convex edge that connects the outwardly presented first exterior edge and the outwardly presented second exterior edge and is arranged to extend substantially along the predetermined arcuate length of the first curved corner segment in each of the collapsed and expanded positions of the frame;

wherein the fabric cover further includes a third straight side segment, a second curved corner segment arranged to interconnect the second and third straight side segments, and a second of the fabric-support branches includes an outwardly presented convex edge that connects the outwardly presented first exterior edge and the outwardly presented second exterior edge and is arranged to extend substantially along the predetermined arcuate length of the second curved corner segment in each of the collapsed and expanded positions of the frame; and wherein the fabric cover further includes a fourth straight side segment arranged to lie in substantially spaced-apart parallel relation to the second straight side segment upon movement of the frame to assume the expanded position, a third curved corner segment arranged to interconnect the third and fourth straight side segments, and a fourth curved corner segment arranged to interconnect the fourth and first straight side segments and wherein the several fabric-support branches are engaged by the respective curved corner segments and folded one over the other in the collapsed position.

19. The sunshade of claim 18, wherein a third of the fabric-supported branches includes an outwardly presented convex edge that is arranged to extend substantially along the predetermined arcuate length of the third curved corner segment in each of the collapsed and expanded positions of the frame and a fourth of the fabric-support branches includes an outwardly presented convex edge that is arranged to extend substantially along the predetermined arcuate length of the fourth curved corner segment in each of the collapsed and expanded positions of the frame.

20. The sunshade of claim 19, wherein the canopy further includes a first mount portion coupled to an underside of the fabric cover and arranged to lie adjacent to the first curved corner segment and cooperate with the fabric cover to provide first pocket means receiving the outer distal portion of the first of the fabric-support branches therein in each of the collapsed and expanded positions of the frame and during movement of the frame between the collapsed and expanded positions, a second mount portion coupled to an underside of the fabric cover and arranged to lie adjacent to the second curved corner segment and cooperate with the fabric cover to provide second pocket means receiving the outer distal portion of the second of the fabric-support branches therein in each of the collapsed and expanded positions of the frame and during movement of the frame between the collapsed and expanded positions, a third mount portion coupled to an underside of the fabric cover and arranged to lie adjacent to the third curved corner segment and cooperate with the fabric cover to provide third pocket means receiving the outer distal portion of the third of the fabric-support branches therein in each of the collapsed and expanded positions of the frame and during movement of the frame between the collapsed and expanded positions, and a fourth mount portion coupled to an underside of the fabric cover and arranged to lie adjacent to the fourth curved corner segment and cooperate with the fabric cover to provide fourth pocket means receiving the outer distal portion of the fourth of the fabric-support branches therein in each of the collapsed and expanded positions of the frame and during movement of the frame between the collapsed and expanded positions.

21. The sunshade of claim 18, wherein the canopy further includes a first mount portion coupled to an underside of the fabric cover and arranged to lie adjacent to the first curved corner segment and cooperate with the fabric cover to provide first pocket means receiving the outer distal portion of the first of the fabric-support branches therein in each of the collapsed and expanded positions of the frame and during movement of the frame between the collapsed and expanded positions.

22. The sunshade of claim 21, wherein the first mount portion and the fabric cover cooperate to form an inner seam therebetween and the outwardly presented convex edge of the outer distal portion included in the first of the fabric-support branches is arranged to engage the inner seam.

23. The sunshade of claim 22, wherein the inner seam includes a concave segment arranged to extend along the predetermined arcuate length of the first curved corner segment and to engage the outwardly presented convex edge of the outer distal portion included in the first of the fabric-support branches.

24. A sunshade comprising a canopy and a central pole under the canopy, the canopy including a frame mounted for movement relative to the central pole between collapsed and expanded positions and a fabric cover coupled to the frame to move therewith relative to the central pole, wherein the frame includes several fabric-support branches each including an outwardly presented first exterior edge and an outwardly presented second exterior edge arranged to underlie and support the fabric cover in the canopy and to extend outwardly away from the central pole upon movement of the frame to the expanded position, the fabric cover includes a perimeter edge having a first straight side segment, a second straight side segment, and a first curved corner segment configured to have a predetermined arcuate length and arranged to interconnect the first and second straight side segments, each fabric-support branch includes an inner root portion arranged to lie in close proximity to the central pole in each of the collapsed and expanded positions of the frame and an outer distal portion arranged to lie in close proximity to the central pole upon movement of the frame to assume the collapsed position and in spaced-apart relation to the central pole upon movement of the frame to assume the expanded position, and the outer distal portion included in a first of the fabric-support branches includes an outwardly presented convex edge that connects the outwardly presented first exterior edge and the outwardly presented second exterior edge and is arranged to extend substantially along the predetermined arcuate length of the first curved corner segment in each of the collapsed and expanded positions of the frame;

wherein the canopy further includes a first mount portion coupled to an underside of the fabric cover and arranged to lie adjacent to the first curved corner segment and cooperate with the fabric cover to provide first pocket means receiving the outer distal portion of the first of the fabric-support branches therein in each of the collapsed and expanded positions of the frame and during movement of the frame between the collapsed and expanded positions;

wherein the first mount portion and the fabric cover cooperate to form an inner seam therebetween and the outwardly presented convex edge of the outer distal portion included in the first of the fabric-support branches is arranged to engage the inner seam;

wherein the inner seam includes a concave segment arranged to extend along the predetermined arcuate length of the first curved corner segment and to engage the outwardly presented convex edge of the outer distal portion included in the first of the fabric-support branches; and wherein the inner seam includes a first side segment arranged to cooperate with the first straight side segment to form an acute included angle therebetween and a second side segment arranged to cooperate with the second straight side segment and the concave segment is arranged to interconnect the first and second side segments of the inner seam.

25. A sunshade comprising a canopy and a central pole under the canopy, the canopy including a frame mounted for movement relative to the central pole between collapsed and expanded positions and a fabric cover coupled to the frame to move therewith relative to the central pole, wherein the frame includes several fabric-support branches each including an outwardly presented first exterior edge and an outwardly presented second exterior edge arranged to underlie and support the fabric cover in the canopy and to extend outwardly away from the central pole upon movement of the frame to the expanded position, each fabric-support branch includes an inner root portion arranged to lie in close proximity to the central pole in each of the collapsed and expanded positions of the frame and configured to have a narrow lateral width and an outer distal portion arranged to lie in close proximity to the central pole upon movement of the frame to assume the collapsed position and in spaced-apart relation to the central pole upon movement of the frame to assume the expanded position, the outer distal portion is configured to have a relatively wider lateral width as compared to the narrow lateral width of the inner root portion, the outwardly presented first exterior edge and the outwardly presented second exterior edge each being connected between the inner roof portion and the outer distal portion, and the outer distal portions are arranged to lie in a flat-fold stack in which the central pole is located in a space provided between two of the outer distal portions when the frame is moved relative to the central pole to assume the collapsed position; and wherein each of the outer distal portions includes a substantially flat panel and the substantially flat panels are arranged to lie in substantially spaced-apart parallel relation to one another when the frame is moved relative to the central pole to assume the collapsed position.

26. A sunshade comprising a canopy and a central pole under the canopy, the canopy including a frame mounted for movement relative to the central pole between collapsed and expanded positions and a fabric cover coupled to the frame to move therewith relative to the central pole, wherein the frame includes several fabric-support branches each including an outwardly presented first exterior edge and an outwardly presented second exterior edge arranged to underlie and support the fabric cover in the canopy and to extend outwardly away from the central pole upon movement of the frame to the expanded position, each fabric-support branch includes an inner root portion arranged to lie in close proximity to the central pole in each of the collapsed and expanded positions of the frame and configured to have a narrow lateral width and an outer distal portion arranged to lie in close proximity to the central pole upon movement of the frame to assume the collapsed position and in spaced-apart relation to the central pole upon movement of the frame to assume the expanded position, the outer distal portion is configured to have a relatively wider lateral width as compared to the narrow lateral width of the inner root portion, the outwardly presented first exterior edge and the outwardly presented second exterior edge each being connected between the inner roof portion and the outer distal portion, and the outer distal portions are arranged to lie in a flat-fold stack in which the central pole is located in a space provided between two of the outer distal portions when the frame is moved relative to the central pole to assume the collapsed position; and wherein the several fabric support branches include first, second, third, and fourth fabric-support branches arranged to lie in series in uniformly spaced-apart relation to one another upon movement of the frame to assume the expanded position, the first and fourth fabric-support branches are arranged to lie on a first side of the central pole upon movement of the frame to assume the collapsed position, and the second and third fabric-support branches are arranged to lie on an opposite second side of the central pole upon movement of the frame to assume the collapsed position to locate the central pole in a space provided between the second and fourth fabric-support branches.

* * * * *